US008187116B2

(12) United States Patent
Boyd et al.

(10) Patent No.: US 8,187,116 B2
(45) Date of Patent: May 29, 2012

(54) GOLF CLUBS AND GOLF CLUB HEADS

(75) Inventors: Robert Boyd, Euless, TX (US); Donald S. Rahrig, Mansfield, TX (US); Andrew Oldknow, Beaverton, OR (US); George W. Moody, Jr., Portland, OR (US); Philip J. Hatton, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 18 days.

(21) Appl. No.: 12/490,154

(22) Filed: Jun. 23, 2009

(65) Prior Publication Data

US 2010/0323812 A1 Dec. 23, 2010

(51) Int. Cl.
*A63B 53/00* (2006.01)

(52) U.S. Cl. ..... 473/329; 473/333; 473/345; 473/288

(58) Field of Classification Search ..... 473/329, 473/332, 333, 345–346
See application file for complete search history.

(56) References Cited

U.S. PATENT DOCUMENTS

| | | | | |
|---|---|---|---|---|
| 4,021,047 | A * | 5/1977 | Mader | 473/345 |
| 4,398,965 | A | 8/1983 | Campau | |
| 4,884,808 | A | 12/1989 | Retzer | |
| 5,766,094 | A | 6/1998 | Mahaffey et al. | |
| 5,776,011 | A | 7/1998 | Su et al. | |
| RE35,955 | E | 11/1998 | Lu | |
| 6,165,081 | A * | 12/2000 | Chou | 473/329 |
| 6,299,547 | B1 | 10/2001 | Kosmatka | |
| 6,348,013 | B1 | 2/2002 | Kosmatka | |
| 6,607,451 | B2 | 8/2003 | Kosmatka et al. | |
| 6,612,945 | B1 | 9/2003 | Anderson | |
| 6,695,715 | B1 * | 2/2004 | Chikaraishi | 473/329 |
| 6,979,270 | B1 | 12/2005 | Allen | |
| 7,416,496 | B2 | 8/2008 | Galloway et al. | |
| 2004/0009829 | A1 | 1/2004 | Kapilow | |
| 2004/0033844 | A1 * | 2/2004 | Chen | 473/329 |
| 2006/0052177 | A1 | 3/2006 | Nakahara et al. | |
| 2006/0148589 | A1 | 7/2006 | Liou | |
| 2007/0049415 | A1 | 3/2007 | Shear | |
| 2007/0049416 | A1 | 3/2007 | Shear | |
| 2007/0049417 | A1 | 3/2007 | Shear | |
| 2008/0139339 | A1 | 6/2008 | Cheng | |
| 2009/0036230 | A1 | 2/2009 | Beach et al. | |
| 2010/0029402 | A1 | 2/2010 | Noble et al. | |
| 2010/0113178 | A1 * | 5/2010 | Stites | 473/329 |

OTHER PUBLICATIONS

International Search Report and Written Opinion issued in corresponding PCT/US2010038762 mailed Sep. 10, 2010.

* cited by examiner

*Primary Examiner* — Stephen L. Blau
(74) *Attorney, Agent, or Firm* — Banner & Witcoff, Ltd

(57) ABSTRACT

Aspects of this disclosure relate to golf club heads which include a wood type golf club head body with a double wall structure that includes a ball striking face portion, which is configured to be disengaged from a rear portion of the golf club head body. Further aspects relate to a second wall portion which is configured to be disengaged from the golf club head body. Golf clubs including these club heads and methods of making such golf club and golf club heads also are provided.

21 Claims, 9 Drawing Sheets

GOLF CLUBS AND GOLF CLUB HEADS

FIELD OF THE DISCLOSURE

The present disclosure relates to golf clubs and golf club heads. Particular example aspects of this disclosure relate to wood type golf clubs and golf club heads having a double wall structure that includes a ball striking face portion, which is configured to be disengaged from a rear portion of the golf club head body.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include a wood-type golf club head body having a double wall structure which includes a ball striking face portion having a first wall (e.g., a ball striking face) and a second wall behind the first wall. According to some aspects of this disclosure, the ball striking face portion may be selectively disengaged (i.e., removed) from the rest of the golf club head body. According to some aspects of this disclosure, the second wall behind the ball striking face portion may be selectively disengaged (i.e., removed) from the rest of the golf club head body. According to some aspects of this disclosure, both the ball striking face portion and the second wall behind the ball striking face may be selectively disengageable (i.e., removable).

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
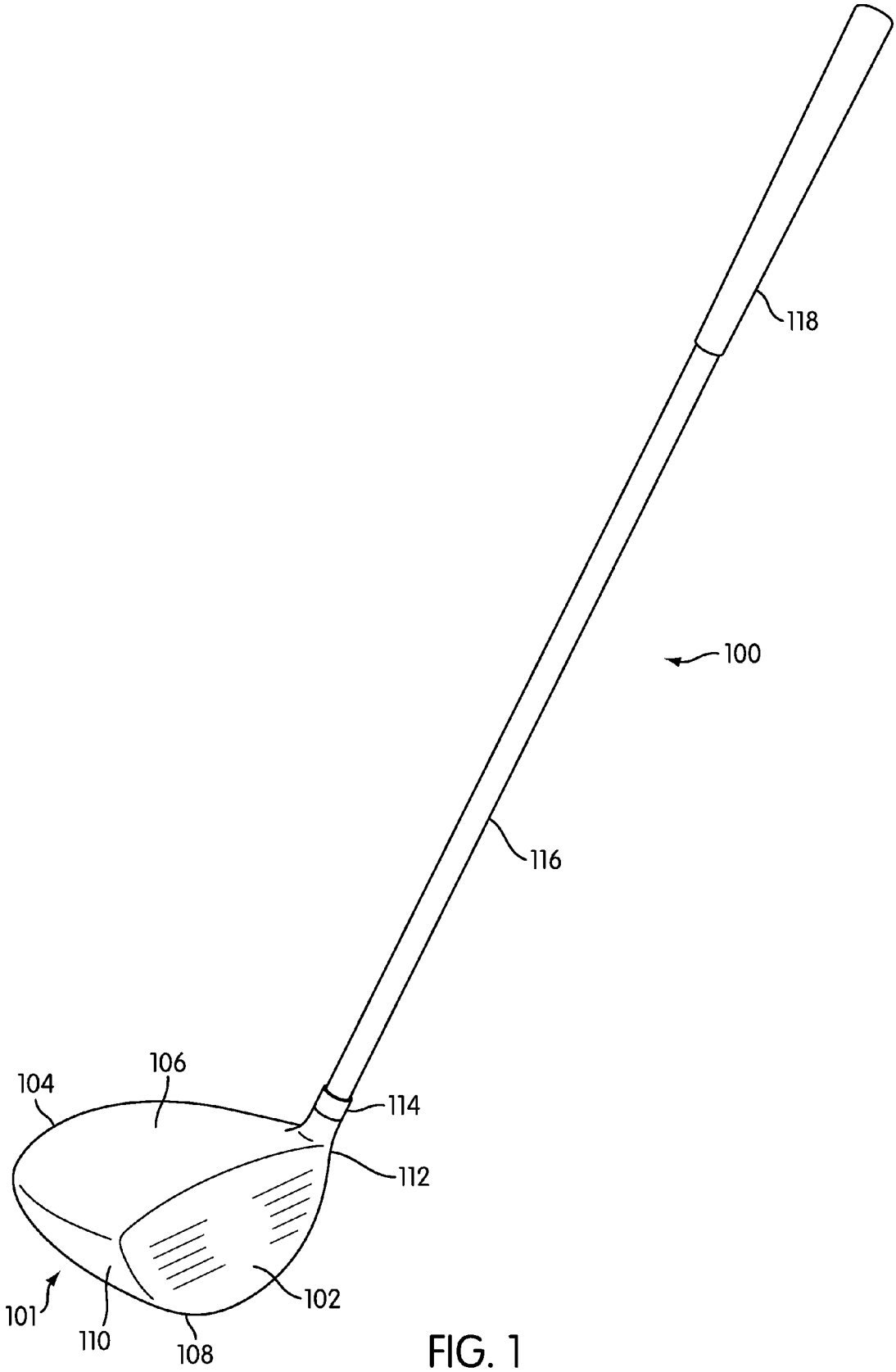
FIG. 1 generally illustrates features of a golf club according to at least some aspects of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Gold Clubs, and Methods in Accordance with this Disclosure As described above, aspects of this disclosure relate to wood-type golf club heads and golf clubs. Wood-type golf club heads according to at least some example aspects of this disclosure may include: (a) a wood-type golf club head body; (b) a ball striking face portion (e.g., including a first wall, such as a ball striking face); (c) a second wall behind the first wall; (d) a top portion; (e) a sole portion; (f) a rear portion opposite the ball striking face portion; (g) a toe end portion; and (h) a heel end portion.

According to aspects of this disclosure, the above described double wall structure (i.e., the face of the ball striking face portion as the first wall of the double wall structure and the second wall behind the ball striking face portion as the second wall of the double wall structure) allows the ball striking face to exhibit a large "trampoline" or "spring-like" effect when it impacts the golf ball, while the second wall can be designed to ensure that the golf club head does not violate any of the limits regarding the Coefficient of Restitution which are set by governing bodies such as the United States Golf Association (USGA) or The Royal and Ancient Golf Club of St. Andrews (R&A).

According to some aspects of this disclosure, the ball striking face portion may be selectively disengaged (i.e., removed) from the rest of the golf club head body. According to some aspects of this disclosure, the second wall behind the ball striking face may be selectively disengaged (i.e., removed) from the rest of the golf club head body. According to some aspects of this disclosure, both the ball striking face portion and the second wall behind the ball striking face may be selectively disengageable (i.e., removable).

Additional aspects of this disclosure relate to wood-type golf club structures that include golf club heads, e.g., of the types described above. Such wood-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing wood-type golf club heads and wood-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-6.

FIG. 1 generally illustrates an example of a wood-type golf club 100 with a wood-type golf club head body 101 in accordance with the present disclosure. As seen in FIG. 1, the club head body 101 of this illustrated example includes a ball striking face portion 102, a rear portion 104 opposite the ball striking face, a crown (i.e. top) portion 106, a sole portion 108, a toe end 110 portion and a heel end portion 112. As seen in FIG. 1, the golf club head body 101 may have a generally conventional shape (although this is not required, e.g., a rectangular or square shape could be employed instead).

In addition to the golf club head body 101, the overall golf club structure 100 of this example includes a hosel region 114, a shaft member 116 received in and/or inserted into and/or through the hosel region 114, and a grip or handle member 118 attached to the shaft member 116. Optionally, if desired, the external hosel region 114 may be eliminated and the shaft member 116 may be directly inserted into and/or otherwise attached to the golf club head body 101 (e.g., through an opening provided in the top of the golf club head body 101, through an internal hosel member (e.g., provided within an interior chamber defined by the club head body 102), etc.). The hosel member 114 may be integrally formed as part of the club head structure 101, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 116 may be received in, engaged with, and/or attached to the club head body 101 in any suitable or desired manner, including in conventional manners known and used in the art, without departing from the disclosure. As more specific examples, the shaft member 116 may be engaged with the club head body 101 via a hosel member 114 and/or directly to the club head structure 101, e.g., via adhesives, cements, welding, soldering, mechanical connectors (such as threads, retaining elements, or the like), etc.; through a shaft-receiving sleeve or element extending into the club head body 101; etc. If desired, the shaft 116 may be connected to the head 101 in a releasable manner using mechanical connectors to allow easy interchange of one shaft for another on the head.

The shaft member 116 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 116 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 116. Additionally, any desired grip or handle member materials may be used without departing from this disclosure, including, for example: rubber materials, leather materials, rubber or other materials including cord or other fabric material embedded therein, polymeric materials, and the like.

The club head body 101 itself also may be constructed in any suitable or desired manner and/or from any suitable or desired materials without departing from this disclosure, including from conventional materials and/or in conventional manners known and used in the art. For example, the club head body 101 and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the club head body 101 described above may be made from multiple pieces that are connected together (e.g., by adhesives or cements; by welding, soldering, brazing, or other fusing techniques; by mechanical connectors; etc.). The various parts (e.g., top portion 106, sole portion 108, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head body 101 according to examples of this disclosure may vary significantly without departing from the disclosure. For example, according to some aspects of the disclosure, the dimensions of the club head body 101 may include a volume between 200-500 cubic centimeters. Further, aspects of the disclosure may apply to any wood-type club head including, for example: drivers, fairway woods, wood-type hybrid clubs, etc.

Figure 2A:
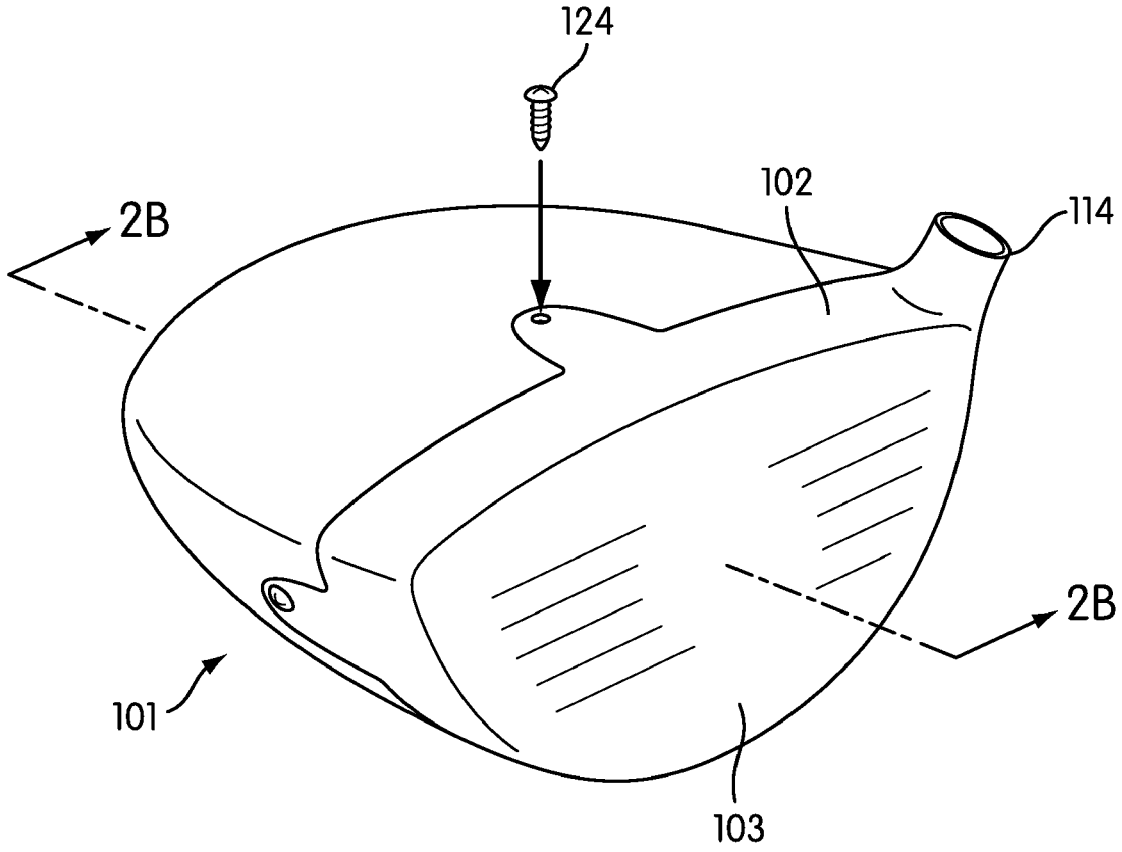
FIG. 2A illustrates the golf club head body shown in FIG. 1.
Figure 2B:
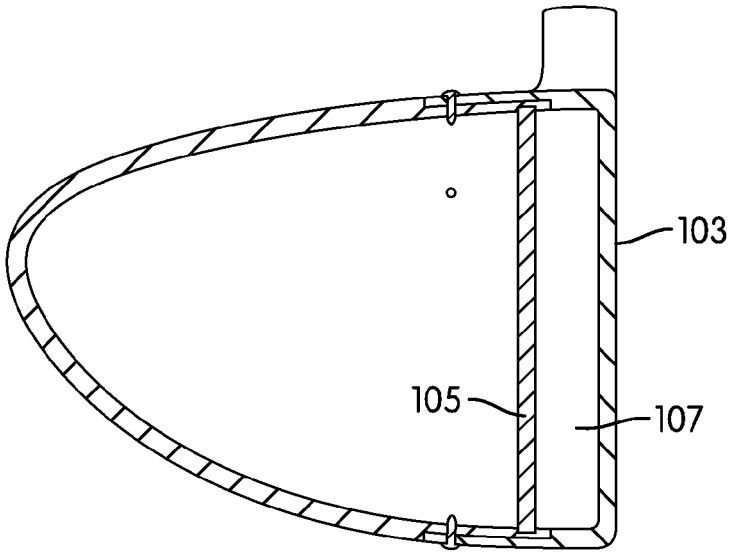
FIGS. 2B and 2C illustrate partial schematic cross-sectional views of the golf club head structure shown in FIG. 2A.
Figure 2C:
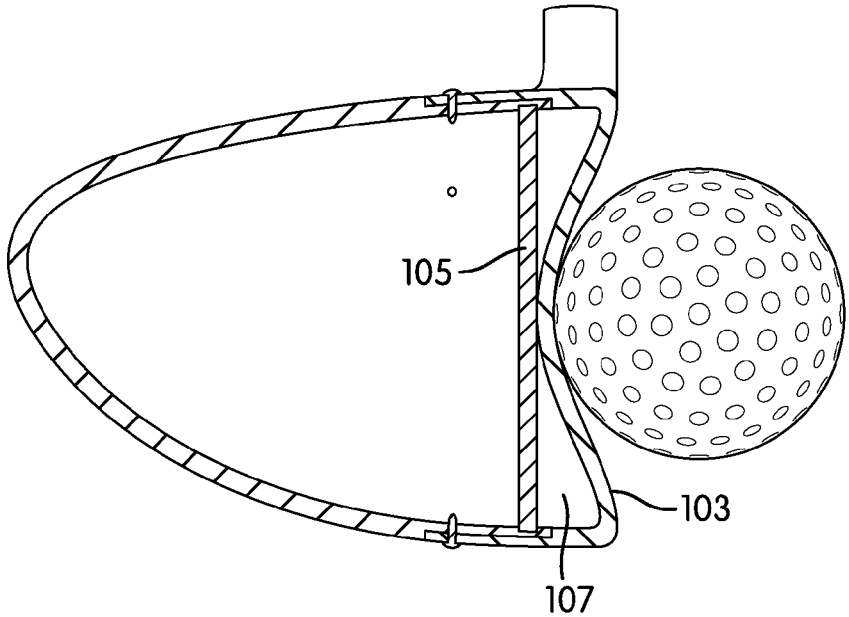

FIG. 2A illustrates an example wood-type golf club head body 101 in accordance with aspects of this disclosure in more detail. Further, FIG. 2B shows a cross sectional view of the club head 101 shown in FIG. 2A. As seen in FIG. 2B, the golf club head body 101 includes a double wall structure. In other words, the club head body 101 has a ball striking face portion 102 which includes a first wall, or ball striking face, 103. Further, as seen in FIG. 2B, the golf club head body 101 includes a second wall 105 behind the ball striking face 103. Also, as seen in FIG. 2B, reference numeral 107 represents a space, or cavity, between the ball striking face 103 and the second wall 105. The cavity 107 allows the ball striking face 103 to deflect inwards during impact for at least a predetermined distance prior to contacting the second wall 105 as shown in FIG. 2C.

As will be described in detail below, the above described double wall structure (i.e., the ball striking face 103 and the second wall 105 which are separated by cavity 107) allows the ball striking face 103 of the ball striking face portion 102 to be exhibit a large "trampoline" or "spring-like" effect when the ball striking face 103 of the golf club head impacts the golf ball, while the second wall portion 105 ensures that the golf club head 101 does not violate any of the limits regarding the Coefficient of Restitution set by golf's governing bodies such as, the USGA or R&A.

Coefficient of Restitution (COR) is a measurement of the energy lost when two objects collide, such as when a golf club head impacts a golf ball. This measurement is expressed as a number between 0 and 1, wherein 0 represents a collision in which all energy is lost and 1 represents a perfectly elastic collision in which no energy is lost and all energy is transferred from one object to another.

The COR of a ball striking face of a golf club head can effect the distance a golf ball will travel upon being stuck by the golf club head. The higher the COR of the ball striking face of the golf club head, the more energy it will transfer to the golf ball upon impact. Therefore, if two golf club heads with different CORs are swung at the same speed, the golf club head with the higher COR will transfer more energy and, as a result, the golf ball will travel a further distance. For example, if two golf clubs with golf club heads that have different CORs of 0.82 and 0.83, respectively, are each swung with a swing speed of 100 mph, the difference in the distance the golf ball will travel after impact would be around 3 to 4 yards.

Therefore, having a golf club head with the highest possible COR would be advantageous as it would provide the longest possible distance. However, the USGA has placed a maximum limit on the COR of a golf club head. The Rules of Golf, as approved by the USGA [see e.g., the 2008 edition], includes a rule at Appendix II, Section 4(c) entitled, Design of Golf Clubs; Clubheads; Spring Effect and Dynamic Properties. The first subsection of this rule states that the design, material and/or construction of, or any treatment to, the club head (which includes the club face) must not have the effect of a spring which exceeds the limit set forth in the Pendulum Test Protocol on file with the USGA. Currently the protocol sets the maximum limit on the COR of a golf club head at 0.830 when the impacting the golf ball at 160 ft/sec. Hence, any golf club head which provides a higher COR when the golf ball is impacted at 160 ft/sec. is illegal and not useable in competitions governed by the USGA. The rationale behind this rule was to protect the integrity of the game and prevent technology from allowing golfers to drive the golf ball "too" far.

The following equation can be used in order to determine the velocity of the ball after impact:

$$v = U + \frac{1+e}{1+m/M}$$

wherein, v=the velocity of the ball after impact; U=the velocity of the club head at impact; e=the coefficient of restitution; m=the mass of the ball; and M=the mass of the club head. As evidenced by this equation, clearly the velocity of the club head at impact has an effect on the velocity of the golf ball after impact, which, in turn, directly relates to the distance the golf ball will travel when struck by the club head. Therefore, as one would likely assume, the greater the swing speed, the greater the distance the golf ball will travel. Conversely, the lower the swing speed, the less distance the golf ball will travel.

However, the USGA's rule limiting the maximum COR of a club head only specifies an impact at 160 ft/sec. Therefore, if the impact is at a speed less than 160 ft/sec., then the maximum COR may be higher than 0.830. For example, if a golf club is swung at a speed of only 140 ft/sec., then the maximum COR of the golf club head at impact could be more than 0.830. Because most of the energy lost during the impact of club head body with the golf ball comes from the golf ball, if the face of the golf club head body is made so that it is highly flexible and resilient, then the golf ball will lose less energy during the impact and the COR will be increased (e.g., above 0.830).

Therefore, aspects of this disclosure relate to the double wall structure described above which allows a golf club head to have a ball striking face that provides a high COR (in some cases higher than 0.830), even when swung at slow speeds. In other words, the ball striking face can be made so that is highly flexible and resilient (e.g., more flexible and resilient than a conventional golf club head face that would provide a COR of 0.83 when swung at 160 ft/sec). For example, the ball striking face may be "ultra" thin (e.g., thinner than conventional ball striking faces that provide a COR or 0.83). With the ball striking face being more flexible, deformable, resilient, etc., the golf ball will not lose as much energy at impact and, therefore, the value of the COR of the ball striking face will be increased. As a result, the velocity of the golf ball at impact will be increased and the golf ball will carry farther. As mentioned above, such a ball striking face could provide a COR of 0.83 or higher when swung at typical amateur speeds (e.g., 140 ft/sec).

However, in order to prevent such a ball striking face from breaking the USGA's COR limit of 0.83 when it is swung at 160 ft/sec., the second wall portion 105 is positioned close enough to the ball striking face 103 to halt the deflection/deformation of the ball striking face 103 and, thereby, limit the maximum obtainable COR if the golf club head is swung at 160 ft/sec or faster. In other words, if such a club is swung at a slow speed, then the deflection of the club face will not be halted by the second wall 105 and, hence, the COR can be as high as the characteristics of the ball striking face 103 (e.g., the dimensions of the ball striking face, such as the thickness; the material used to the make ball striking face, etc.) will allow. On the other hand, if the club is swung at a high speed, the positioning of second wall 105 ensures that the ball striking face cannot deflect fully (i.e., deflect as much as the characteristics of the ball striking face (e.g., the dimensions of the ball striking face, such as the thickness; the material used to the make ball striking face, etc.) will allow) and, hence, cannot achieve the full COR that the characteristics of the ball striking face would have provided. Thereby, the second wall 105 is positioned from the ball striking face 103, based on the characteristics of the ball striking face such that only a maximum COR value of 0.83 is obtainable if the golf club head is swung at 160 ft/sec or faster. Therefore, it is appreciated that the double wall structure allows slow swing speed golfers to achieve the same (or even greater) amount of "trampoline" or "spring-like" effect from the ball striking face 103 as high speed golfers and, hence, slow swing speed golfers are not "penalized" by the USGA's rules regarding COR.

In view of the above discussion, it is understood that it would be advantageous for a golfer to obtain the highest possible COR allowed by the rules. Further, as described above, the highest possible COR that a particular golfer can achieve would depend, at least in part, on the particular golfer's swing speed and the particular characteristics of the ball striking face 103. Hence, it is appreciated that a particular ball striking face may not provide the maximum COR for golfers with different swing speeds.

Therefore, aspects of this disclosure relate to selectively removable and interchangeable portions of golf club head bodies that include a double wall structure. Specifically, some aspects of the disclosure relate to ball striking face portions 102 that may be configured to be selectively disengaged (i.e., removed) from the rear portion of the golf club head body. Further, some aspects of the disclosure relate to ball striking face portions 102 are interchangeable with other ball striking face portions that can be attached to the rear portion of the club head body. By providing such ball striking face portions 102, the ball striking face 103 can be customized to the particular golfer.

Further, in a double wall structure, the positioning of the second wall may also effect the highest possible COR that a particular golfer can achieve. Therefore, aspects of this disclosure relate to second walls of double wall golf club head bodies that may be selectively disengaged (i.e., removed) from the golf club head body 101. Further, some aspects of the disclosure relate to second walls that are interchangeable and adjustable. By providing such second walls, the double wall golf club head body can be customized to the particular golfer.

Figure 2D:
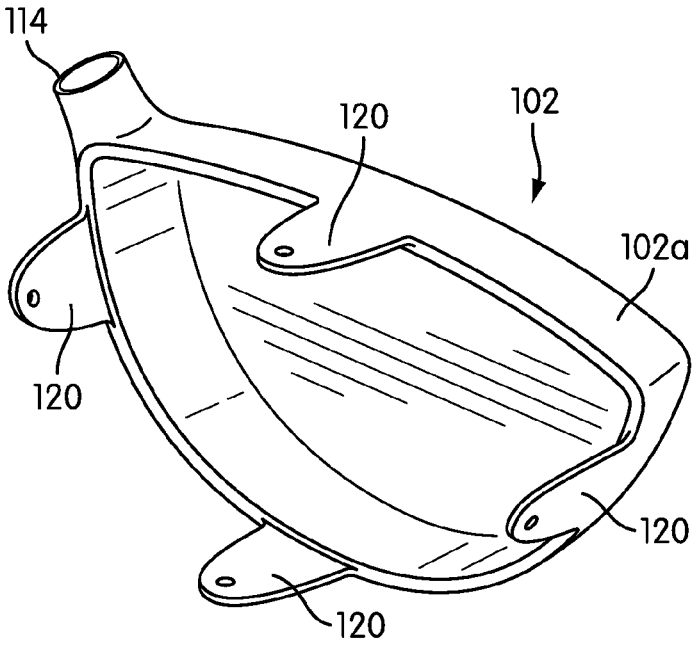
FIGS. 2D and 2E illustrate portions of the golf club head structure shown in FIG. 2A.

FIG. 2D shows an illustrative embodiment of a ball striking face portion 102 for a golf club head body 101 with a double wall structure, wherein, according to aspects of this disclosure, the ball striking face portion 102 is configured to be selectively disengaged (i.e., removed) from the rest of the golf club head body 101. As seen in FIG. 2D, the ball striking face portion 102 may be a separate element (or group of elements) that is attached to the rest of the golf club head body 101. Further, according to particular aspects of this disclosure, and as seen in FIG. 2D, the ball striking face portion 102 may be a "cup" shape. In other words, the ball striking face portion 102 includes a ball striking face 103 and an outer perimeter portion 102*a* that includes a portion which extends rearwardly away from the ball striking face 103 in a direction relatively perpendicular to the ball striking face 103 so as to form a "cup" shape. Further, engaging portions 120 may extend from the outer perimeter portion 102*a*. In the depicted embodiment, the engaging portions 120 are flanges positioned on each of the sole portion, crown portion, toe end portion and heel end portion of the outer perimeter portion 102*a* of the ball striking face portion 102. Each of the flanges 120 may include a screw hole. Once engaged to the rest of the club head body, the ball striking face portion 102 may form a portion of at least one of the top, sole, toe or heel portions of the golf club head body 101. Further, as can be seen in FIG. 2D, the outer perimeter portion 102*a* may include the hosel 114.

Figure 2E:
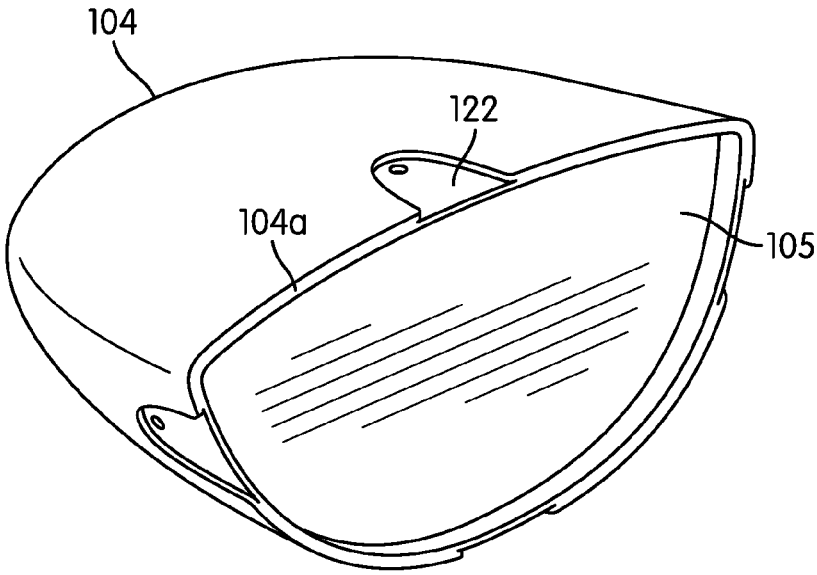

FIG. 2E shows an illustrative embodiment of a rear portion of the golf club head body 104 for a golf club head body 101 with a double wall structure according to aspects of this disclosure. As can be seen in FIG. 2E, the rear portion 104 includes at least portions of the crown portion 106, the sole portion 108, the toe end 110 portion and the heel end portion 112. Further, the rear portion 104 includes receiving portions 122 for receiving the engaging portions 120 of the ball striking face portion 102. In the depicted embodiment, the receiving portions 122 are recesses positioned in each of the sole portion, crown portion, toe end portion and heel end portion of the rear portion 104. Each of the recesses 122 may include a screw hole. Further, according to some aspects of this disclosure the rear portion of the club head body 104 can also include the second wall 105. For example, as seen in FIG. 2E, the second wall 105 can be positioned within the rear portion 104 so that it separates the rear portion 104 into separate portions including a first hollow compartment behind the second wall 105 and an open face portion in front of the second wall 105. As seen in FIG. 2E, the rear portion 104 includes a perimeter portion 104*a*.

The interchangeable ball striking face portion 102 and the rear portion of the golf club head body 104 can be engaged to form the golf club head body 101. In the depicted embodiment, the "cup" shape of outer perimeter portion 102*a* of the ball striking face portion 102 engages with the perimeter portion 104*a* of the open face of the rear portion of the golf club head body 104. For example, the outer perimeter portion may align with or surround the perimeter portion of the open face of the rear portion of the golf club head body 104. Further, the flanges 120 of the ball striking face portion 102 may be fit into the receiving portions 122 of the rear portion of the golf club head body 104. Further, according to some aspects of this disclosure, the rear portion of the club head body 104 may include a ridge in the proximity of the perimeter portion 104*a*. The outer perimeter portion 102*a* of the ball striking face portion 102 can engage and be supported by the ridge of the rear portion 104. For example, the outer perimeter portion 102*a* can surround and fit over the ridge. It is noted that the dimensions of the flanges 120 and the receiving portions 122 can be configured so that when engaged, the club head body 101 is essentially seamless (e.g., the depth of the receiving portions 102 can accommodate the thickness of the flanges 120 so the surface of the golf club head body 101 is relatively smooth). In the depicted embodiment, once the ball striking face portion 102 and the rear portion of the golf club head body 104 are engaged, screws 124 can be used to secure ball striking face portion 102 to the rear portion of the golf club head body 104. The screws 124 may be counter sunk so that they will not interfere with the aerodynamics of the club head body 101 during the swing.

It is noted that both the ball striking face portion 102 and the rear portion of the golf club head 104 may be configured so that when engaged they provide an appropriate cavity 107 between the ball striking face 103 and the second wall portion 105. For example, a ridge of the rear portion of the club head body 104 and the outer perimeter portion 102*a* of the ball striking face portion 102 may be dimensioned so that when the outer perimeter portion 102*a* of the ball striking face portion 102 is engaged with the ridge of the rear portion of the golf club head body 104, their engagement provides the ball striking face 102 at the appropriate distance from the second wall 105.

It is noted that the depicted embodiment is merely one example of the club head body 101. Other ball striking face portions, rear portions of the golf club head, means of securing the portions, etc. may be used. For example, the flanges 120 and receiving portions 122 could be eliminated and, instead, the ball striking face portion 102 and the rear body of the golf club head 104 could be configured to merely have corresponding/mating ridge portions. Similarly, instead of screws 124, the ball striking face portion 102 may be secured to the rear body of the golf club head 104 in a variety of other ways, including other mechanical connectors such as threads, retaining elements, projections in the ball striking face 102 engaging corresponding holes in the rear portion of the golf club head 104 (or vice versa), spring loaded projections and corresponding recesses, snap fit features, etc. Any combination of securing or coupling means, ball striking face portions and rear portions could be used as desired.

Such releasable methods of attachment provide secure engagement of the ball striking face 102 with the rear portion of the golf club head body 104, but also allow for easy interchange of one ball striking face portion 102 for another. In this way the golf club head can be quickly and easily customized for a particular golfer. For example, during club fitting, based on an average measured swing speed for a particular golfer, a club fitter may "swap" out a first ball striking face portion that has a first ball striking face with a second ball striking face portion that has a second ball striking face that will provide a higher (but still conforming) COR.

In is noted, in such embodiments a tool may be used to attach and/or release the interchangeable ball striking face portions 102 from the club head body 101. It is further noted that while some mechanical connectors have been described above, this is not to imply that mechanical connectors must be used. On the contrary, as long as the ball striking face portion 102 and the rear portion of the golf club head 104 can be engaged securely to one another, and also easily releasable from one other, such means are considered within the spirit of this disclosure.

Figure 2F:
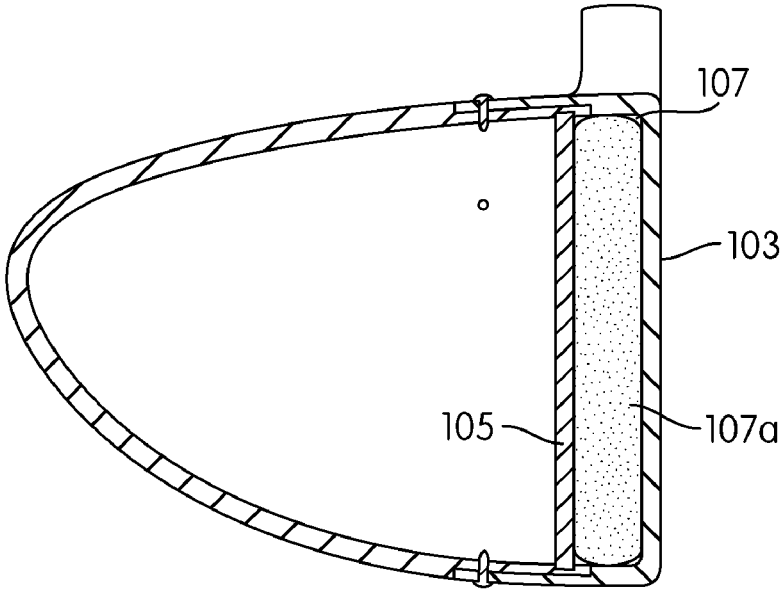
FIGS. 2F and 2G illustrate partial schematic cross-sectional views of the golf club head structures according to some aspects of this disclosure.

According to other aspects of this disclosure, an element may be included between the ball striking face 103 and the second wall 105. For example, FIG. 2F illustrates an embodiment of an aspect of this disclosure wherein an airbag 107*a* is positioned within the cavity 107 of the golf club head body 101. The air bag 107*a* will affect the resiliency of the ball striking face 103 when it is deformed at impact as shown in FIG. 2C. Therefore, it will have an effect on the COR of the golf club head body 101. The air bag 107*a* may be sized as desired so that it partially substantially or even entirely fills the cavity 107. The air bag 107*a* may be made from conventional materials (e.g., polyester fiber) that will withstand repeated deformations and still provide the appropriate resiliency.

Figure 2G:
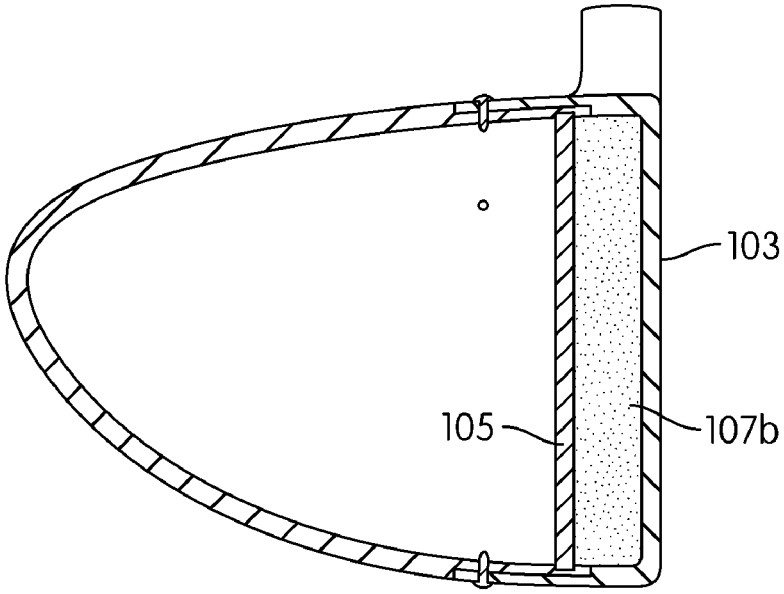

Of course, other elements could be included between the ball striking face 103 and the second wall 105. For example, FIG. 2G illustrates an embodiment of an aspect of this disclosure wherein a material 107*b* is included within the cavity 107 of the golf club head body 101. The material 107*b* may be a polymer, polymeric material, plastic, elastomer or elastomeric material, etc. For example, silicone may be used as the material 107*b*. Similarly to the above described air bag, the material 107*b* will affect the resiliency of the ball striking face 103 when it is deformed at impact as shown in FIG. 2C. Therefore, it will have an effect on the COR of the golf club head body 101. The material 107*b* may partially substantially or even entirely fill the cavity 107.

As discussed in detail above, the ball striking face 103 can be made so that is more flexible and resilient than a ball striking face for a conventional golf club head (e.g., a ball striking face of a golf club head without a double wall structure that would provide a COR of 0.83 when swung at 160 ft/sec.). The thinness of the ball striking face 103 and the strength and resiliency of the material from which it is made will effect how quickly the face 103 deflects and rebounds during impact with the golf ball. In order to increase the COR of the ball striking face 103, the ball striking face 103 can be made "ultra" thin (e.g., relatively thin in relation to conventional golf club head's ball striking faces). For example, the thickness of the ball striking face 103 may be between 0.1-6.0 millimeters; 1.3-3.0 millimeters; 1.5-2.0 millimeters; 1.8 millimeters; etc. Of course, the thickness of the ball striking face 103 does not have to be the same throughout the entire ball striking face 103. For example, the center of the ball striking face 103 could be thinner than the outer edges of the ball striking face. Further, it is noted that the ball striking face 103 made be made from a strong and resilient material such as titanium, steel, titanium or steel alloys, composites, etc.

It is noted that due to its "ultra" thinness, the ball striking face 103 of a double wall structure, may be more prone to failure than the ball striking face of a conventional golf club head body. Therefore, the ability to the remove and replace the ball striking face portion 102 as taught by this disclosure may be particularly advantageous for golf club heads with double wall structures since, upon failure, the ball striking face 102 may be easily replaced as opposed to the entire club head having to be replaced. This will be not only cost effective, but also save considerable time and effort.

Further, it is further noted that the "cup" shape structure of the ball striking face portion 102 is advantageous in such a removable and interchangeable environment for a double wall structure, because it allows the ball striking face portion 102 to be engaged to the rear portion of the golf club head 104 without affecting the integrity of the structure of the "ultra" thin ball striking face 103 itself For example, by using a "cup" shape, the outer perimeter portion 102*a* of the ball striking face portion 102 can be engaged with the perimeter of the open face of the rear portion of the golf club head body 104 by aligning the outer perimeter portion 102 with, or fitting the outer perimeter portion 102 around, the perimeter of the open face of the rear portion 104 and further, engaging and securing the flanges 120 of the ball striking face portion 102 into the receiving portions 122 of the rear portion 104. Therefore, no securing means, such as screws, have to be attached through the already thin ball striking face 103. Hence, the strength of the "ultra" thin ball striking face 103 will not be decreased or unduly compromised.

As will be described in detail below, the size of the cavity 107 can be controlled as desired in order to ensure an appropriate amount of deflection of the ball striking face 103. According to some aspects of this disclosure, the cavity 107 may be between 0.1-6.0 millimeters; 0.3-3.0 millimeters; 1.0-1.9 millimeters; 1.2-1.6 millimeters; 1.5 millimeters, etc.

The second wall 105 may be a formed as part of the golf club head body or, alternatively, the second wall 105 may be a separate element (or group of elements) attached to the golf club head body 101. The second wall 105 may be made from the same or different materials as the rest of the golf club head body 101. For example, the second wall 105 may be made from a material, such as steel, titanium, aluminum, metallic material, carbon graphite composite, injected molded polymer, etc. Additionally, or alternatively, the second wall portion 105 may be the same thickness as, or be thicker or thinner than, the ball striking face 103. For example, the second wall may be between 0.1-6.0 millimeters; 1.3-3.0 millimeters; 1.5-2.3 millimeters; 2.0 millimeters; etc. Due to the second wall's stiffness characteristics (and its positioning), the second wall 105 can halt the deflection/deformation of the ball striking face 103 and, thereby, prevent the ball striking face 103 from deflecting more than a predetermined amount during impact with the golf ball.

Figure 3A:
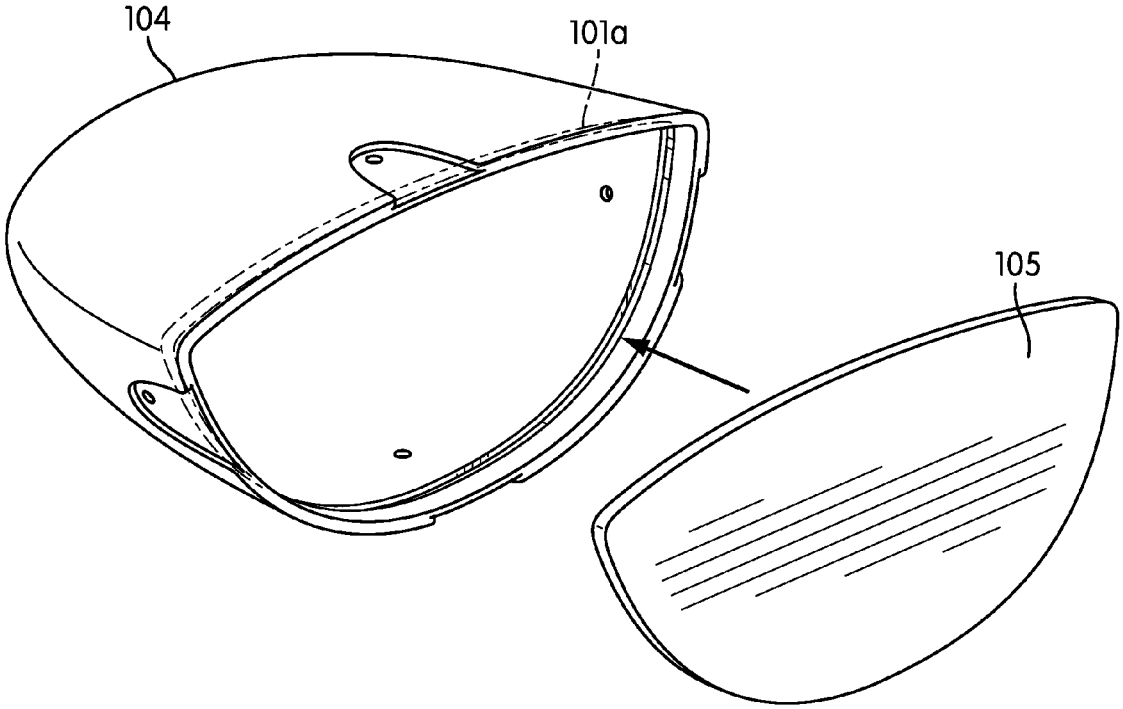
FIG. 3A is an exploded view of a rear portion of a golf club head structure according to at least some examples of this disclosure.

According to aspects of this disclosure, such as seen in FIG. 2E, the second wall 105 may have a face that extends across the interior of the golf club head body 101 from the heel portion to the toe portion and crown portion to the sole portion. As shown in FIG. 3A, the second wall 105 may be a single plane of material. The single plane second wall 105 may be formed with the golf club head body, or, alternatively, as shown in FIGS. 3A and 3B, the single plane second wall's perimeter edges may be attached to the interior of the golf club head body 101.

According to other aspects of this disclosure, the second wall 105 may include a flange 105*a* that extends rearwardly from the face of the second wall 105. For example, FIG. 3C is an illustrative embodiment of a second wall 105 with such a flange 105*a*. As seen in the depicted embodiment, the flange 105*a* extends around the periphery of the second wall 105. The flange 105*a* can be used to secure the second wall 105 to the interior of the golf club head body. The flange 105*a* can be of any size that would be adequately engage with the interior of the golf club head body 101 and secure the second wall 105 to the golf club head body 101. It is noted that this is merely one embodiment of the flange 105*a* and other embodiments may be employed. For example, as seen in FIG. 3D, instead of a single flange 105*a* which extends around the periphery of the second wall 105, multiple flanges 105*a* could be used. As seen, such an embodiment could include a flange 105*a* on each of the toe and heel side and/or crown and sole side of the second wall 105.

Figure 3B:
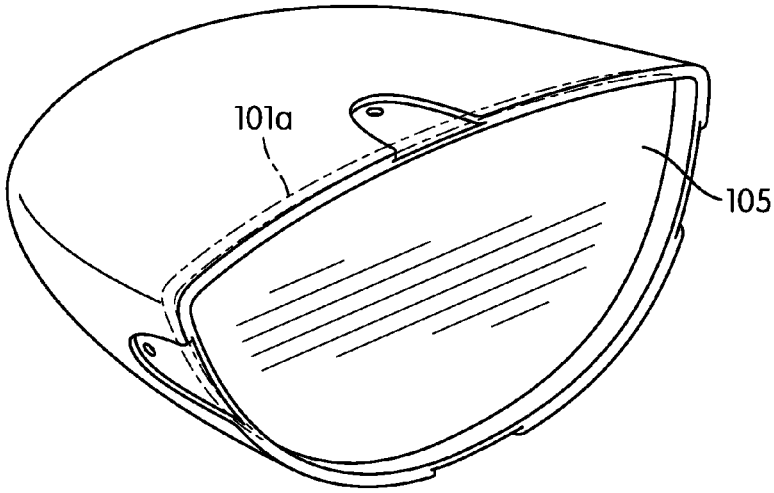
FIG. 3B is view of a rear portion of the golf club head structure shown in 3A, wherein the second wall is incorporated into the rear portion of the golf club head body according to at least some examples of this disclosure.
Figure 3C:
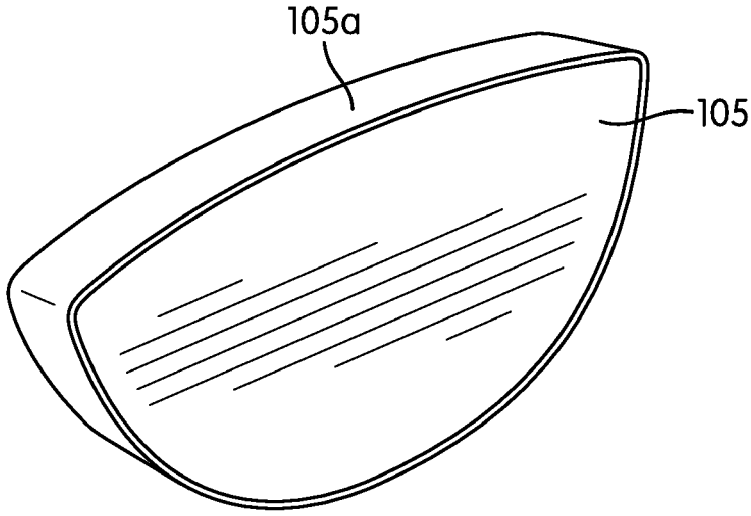
FIGS. 3C and 3D illustrate the various second walls of the golf club head structures according to at least some examples of this disclosure.
Figure 3D:
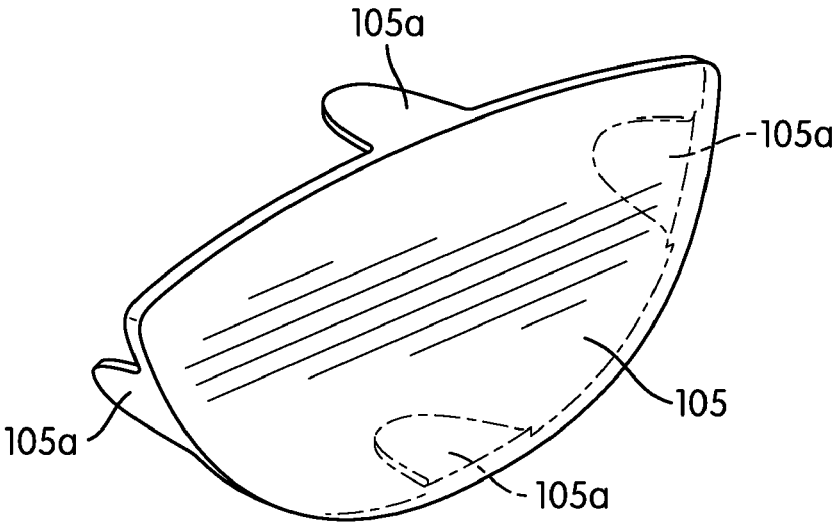

According to some aspects of this disclosure, and as shown in FIGS. 3A-B, the interior of the golf club head body 101 may include a recess(es) (e.g., grooves) 101*a*, in the interior of the golf club head body 101 for receiving the perimeter edges or flange(s) 105*a* of the second wall 105. The recess(es) 101*a* may be configured to accommodate the perimeter edges or the flange(s) 105*a* so that when the perimeter edges or flange(s) 105*a* are engaged and secured to the recess(es) 101*a*, the face of the second wall 105 is provided in the appropriate position in order to prevent the excessive deflection of the ball striking face 103 and, hence, the ball striking face 103 from having a COR higher than 0.83 when the golf club is swung at 160 ft/sec. The recesses 101*a* may be formed in the interior of the of the golf club head body 101 during manufacture or may be created by extruding portions of the interior of the golf club head 101. It is noted, of course, the perimeter edges of the second wall 105 or the flange(s) 105*a* may be attached directly to the interior of the golf club head body 105 without the use of recesses 101*a*.

Figure 4A:
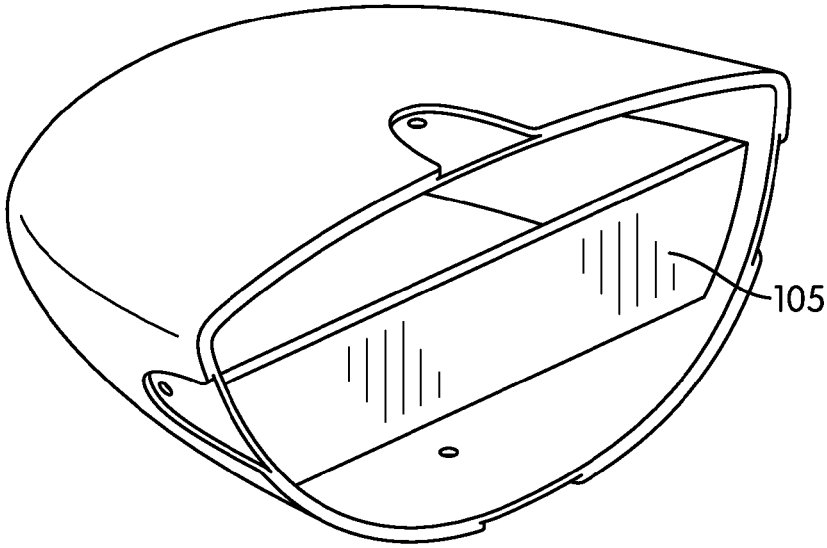
FIGS. 4A-B illustrate various views of an alternative second wall of golf club head structure incorporated into a golf club head body according to at least some examples of this disclosure.
Figure 4B:
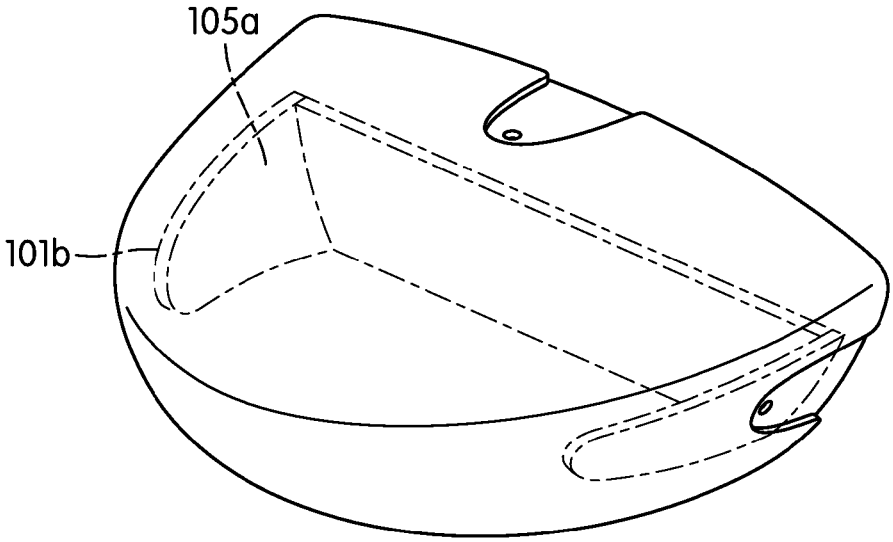

According to other aspects of this disclosure, and as shown in FIGS. 4A and 4B, instead of extending across the entirety of the interior of the golf club head body 101 as described above, the second wall 105 may be a strip that extends across the interior of the golf club head body 101 around the center portion of ball striking face 103 (e.g., from the heel portion to the toe portion or the crown portion to the sole portion). It is noted that in such embodiments, the strip should be of a size that ensures it will prevent the excessive deflection of the ball striking face 103 regardless of where the ball striking face 103 impacts the golf ball (i.e., the strip should prevent the excessive deflection of the ball striking face 103 even if the impact location is outside of the "sweet spot"). According to aspects of this disclosure, and as seen in FIG. 4B, the strip second wall 105 may include a flange 105*a* (such as described above) on each of the toe and heel side (or crown and sole side) of the second wall 105 so that the strip second wall 105 exhibits a "U" or "horseshoe" shape. As seen in the depicted embodiment, the flanges 105*a* may have a length that is more than 50% of the length of the face of the second wall 105. Further, as seen by the dashed lines in FIG. 5B, recesses 101*b*, for receiving the flanges 105*a* of the second wall 105, such as described above, may be provided in this embodiment as well.

According to aspects of this disclosure, regardless of the configuration of the second wall 105 (e.g., whether the second wall 105 has a face which extends across the entirety of the interior of the golf club head body 101 or is a strip that extends across the interior of the golf club head body 101 around the center portion of ball striking face 103; etc.), the second wall 105 may be fixed in its position within the golf club head body 101. For example, the second wall 105 may be actually formed with the club head body 101 or, alternatively, the second wall 105 may be secured to the interior of the golf club head body 101 by attaching the second wall 105 to the interior of the rear portion of the golf club head body 104 in a relatively permanent fashion (e.g., if the second wall is a separate element that is not formed with the golf club head body, then the second wall's perimeter edges and/or flanges could be attached directly to the interior of the rear portion of the golf club head 104 by adhesives or cements; by welding, brazing, soldering, or other fusing techniques; etc.). According to some aspects of this disclosure, the second wall 105 could be formed within or attached directly to the interior of either of the rear portion of the golf club head 104 or the ball striking face portion 102.

In embodiments wherein the second wall 105 is fixed in its position in the interior of the rear portion of the golf club head 104, the cavity 107 between the ball striking face 103 and the second wall 105 will be dependent primarily on the structure of the interchangeable ball striking face portion 102. Therefore, the interchangeable ball striking face portion 102 may be specifically configured based on the characteristics of the ball striking face 103 (e.g., thinness of the ball striking face 103, the material from which the ball striking face 103 is made, the resiliency of the ball striking face, etc.), to provide an appropriate cavity 107 when the interchangeable ball striking face portion 102 is engaged with the rear portion of the golf club head body 104 that will ensure the COR of the ball striking face portion is not more than 0.83 when the golf club head body is swung at 160 ft/sec. For example, if the ball striking face 103 is made from titanium and between 1.3-3.0 millimeters thick, then the outer perimeter portion 102*a* of interchangeable ball striking face portion 102 may be configured (e.g., sized on shaped) so that the cavity is between 1.0 and 1.9 millimeters (e.g., 1.5 mm). In contrast, if the ball striking face 103 is made from steel and thicker than 3.0 millimeters thick, then the outer perimeter portion 102*a* of the interchangeable ball striking face portion 102 may be configured (e.g., sized on shaped) so that the cavity 107 is less than 1.5 mm.

Figure 5:
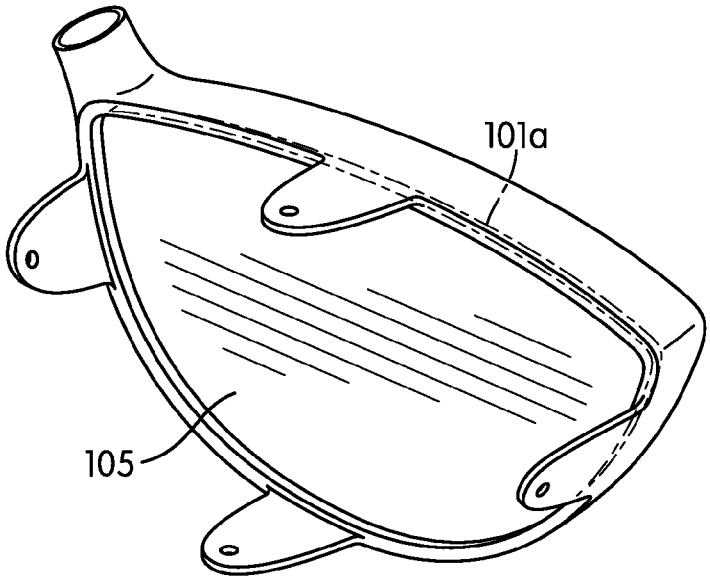
FIG. 5 illustrates a second wall of a golf club head structure incorporated into a golf club head body according to at least some examples of this disclosure.

According to other aspects of this disclosure, and as seen in FIG. 5, the second wall 105 could be fixed in interior of the ball striking face portion 102. For example, the second wall 105 could be actually formed in the ball striking face portion 102 or, alternatively, attached to the interior of the ball striking face portion 102 (in a manner such as described above). If the second wall 105 is a separate element that is attached to the interior of the ball striking face portion 102, the interior of the ball striking face portion 102 could include recesses 101*a* (such as described above) for receiving the perimeter edges or flanges 105*a* of the second wall 105. By incorporating both the walls of the double wall structure (i.e., the ball striking face 103 and the second wall 105) into the ball striking face portion 102, the cavity 107 could be set at the appropriate distance regardless of which rear portion of the golf club head body 104 to which the interchangeable ball striking face portion 102 was attached. This would ensure the golf club head body 101 is conforming to the USGA's rules on COR regardless of which rear portion of the golf club head body 104 to which the interchangeable ball striking face portion 102 was attached.

The above described embodiments are not meant to suggest that the second wall 105 must be permanently fixed in position within the golf club head body 101. On the contrary, according to aspects of this disclosure, the second wall 105 may be selectively disengaged (i.e., removed) and/or interchangeable. For example, when the interchangeable ball striking face portion 102 is disengaged from the rear portion of the golf club head body 104, the second wall 105 may be insertable into and removable from the portion of the golf club head body 101 to which the second wall 105 is engageable (e.g., either of the rear portion of the golf club head body 104 of the ball striking face portion 102) via a releasable means. For example, mechanical connectors such as threads, retaining elements, spring loaded projections and corresponding recesses, snap fit features, etc. may be employed. For example, the second wall 105 could be snap fit into recesses 101*a* in the ball striking face portion 102 or the rear portion 104. Such releasable methods of attachment provide secure engagement of the second wall 105 with either of the rear portion of the golf club head body 104 or the ball striking face 102, but also allow for easy interchange of one second wall 105 for another. It is noted, in such embodiments a tool may be used to attach and/or release the second wall from the club head body 101. It is further noted that while some mechanical connectors have been described above, this is not to imply that mechanical connectors must be used. On the contrary, as long as the second wall and the golf club head 104 can be engaged securely to one another and, also, easily releasable from one other, such means are considered within the spirit of this disclosure.

By allowing the second wall of the double wall structure to be interchangeable, different characteristics of the club head body may be altered. For example, interchangeable second walls may have different thicknesses, be made from different materials, have different weights, densities, weight distributions, and/or other different weighting characteristics. Hence, it is appreciated that the second wall 105 can be interchanged in order to modify weighting characteristics of the club and, therefore, affect golf ball trajectories (e.g., providing more weight at the toe, heel upper or lower portions of the second wall 105 may cause the ball to follow a draw, fade, more lofted, or more boring trajectory).

Figure 6:
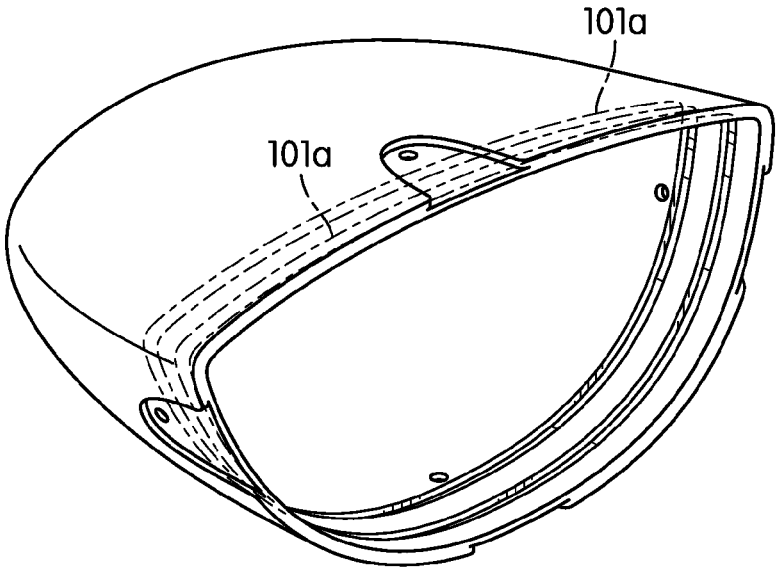
FIG. 6 illustrates a rear portion of a golf club head structure according to at least some examples of this disclosure.

According to some aspects of this disclosure, in addition to the second wall 105 being removable and interchangeable, the second wall 105 may also be adjustable. For example, as seen in FIG. 6, the interior of the club head body 101 (e.g., the interior of the ball striking face portion 102 or the rear portion of the club head body 104) may include a plurality of recesses 101*a* wherein the second wall 105 may be inserted into each of the recesses 101*a* depending on the particular characteristics of the ball striking face 103 (as described above), in order to provide the appropriate cavity 107. Further, the recesses 101*a* could be formed (and indentified by marking) to correspond to the particular ball striking faces 103 that would be used. For example, if the above described titanium ball striking face 103 was used, the recess 101*a* that would provide the appropriate cavity 107 to ensure the COR was no more than 0.83 at a swing speed of 160 ft/sec could be marked as corresponding to the that particular ball striking face so that the interchangeable second wall 105 may be inserted into that recess 101*a* quickly and accurately. Similarly, if the above described steel ball striking face 103 was used, its respective recess could be marked as such. Hence, it is realized, that such a system provides easy and accurate positioning of the second wall within the club head body 101. In this way the golf club head can be quickly and easily customized for a particular golfer. For example, during club fitting, if a new ball striking face portion 102 has been used, a club fitter may alter the position of the second wall 105 so that the club head body 101 will provide a higher (but still conforming) COR.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 6 may be used individually and/or in any combination or subcombination without departing from this disclosure.

We claim:

1. A golf club head comprising:

a wood type golf club head body with a double wall structure, wherein the wood type golf club head body includes:

a ball striking face portion which includes a first wall and an outer perimeter portion, a rear portion opposite to the first wall and engaged with the ball striking face portion;

a crown portion;

a sole portion;

a toe end portion;

a heel end portion; and a second wall behind the first wall, wherein a cavity between 0.1-6.0 millimeters is defined between the first wall and the second wall, wherein the ball striking face portion is configured to be disengaged from the rear portion of the golf club head body, wherein the ball striking face portion has a cup shape wherein the outer perimeter portion includes a portion which extends rearwardly away from the first wall and engages with a perimeter portion of an open face of the rear portion of the golf club head body, wherein the outer perimeter portion does not include more of a bottom surface of the wood type golf club head body than the rear portion of the golf club head.

2. The golf club head according to claim 1, wherein the outer perimeter portion aligns with or surrounds the perimeter portion of the open face of the rear portion of the golf club head body.

3. The golf club head according to claim 2, wherein the ball striking face portion is engaged with the rear portion of the golf club head body via releasable mechanical connectors.

4. The golf club head according to claim 2, wherein the outer perimeter portion of the ball striking face portion includes one or more flanges, further wherein the rear portion of the golf club head body includes one or more receiving portions for receiving the flanges.

5. The golf club head according to claim 4, wherein the one or more flanges and the one or more receiving portions contain screw holes and the ball striking face portion is engaged with the rear portion of the golf club head body via screws.

6. The golf club head according to claim 1, wherein when the ball striking face portion and the rear portion are engaged, the cavity defined between the first wall and the second wall allows the first wall to fully deflect upon impact when the golf club head is swung at a first speed, and when the golf club head is swung at a second speed, the cavity prevents the first wall from fully deflecting upon impact.

7. The golf club head according to claim 6, wherein the first speed is a speed less than 160 ft/sec and the second speed is a speed of 160 ft/sec or more.

8. The golf club head according to claim 1, wherein the cavity is between 1.0-1.9 millimeters.

9. The golf club head according to claim 1, wherein the first wall has a thickness between 1.3-3.0 millimeters.

10. The golf club head according to claim 1, wherein the second wall has a thickness between 1.3-3.0 millimeters.

11. The golf club head according to claim 1, wherein the second wall includes at least one flange which engages with an interior of the golf club head at least one of the toe end portion and the heel end portion.

12. The golf club head according to claim 11, wherein the interior of the golf club head body includes at least one recess for receiving the at least one flange of the second wall.

13. The golf club head according to claim 1, wherein the second wall comprises a strip that extends across an interior of the golf club head around the center portion of first wall, further wherein the second wall includes a flange on at least two opposite sides so that the second wall exhibits a "U"-shape.

14. The golf club head according to claim 1, wherein the second wall is configured to be removably engagable with an interior of the golf club head.

15. The golf club head according to claim 14, wherein the second wall is engaged with the interior of the golf club head body via releasable mechanical connectors.

16. The golf club head according to claim 15, wherein the interior of the golf club head body includes a plurality of recesses for receiving the second wall, wherein the recesses are spaced from each other based on characteristics of the first wall.

17. The golf club head according to claim 1, wherein the ball striking face portion and the second wall are configured to be engaged, wherein the second wall is engaged within an interior of the outer perimeter portion of ball striking face portion.

18. The golf club head according to claim 1, further comprising an airbag positioned in the cavity defined between the first wall and the second wall.

19. The golf club head according to claim 1, further comprising a material positioned in the cavity defined between the first wall and the second wall, wherein the material is one of a polymer, polymeric material, plastic, elastomer or elastomeric material.

20. A golf club head comprising:

a wood type golf club head body with a double wall structure, wherein the wood type golf club head body includes:

a cup shaped ball striking face portion which includes a first wall, an outer perimeter portion which extends rearwardly away from the first wall, and one or more engaging portions;

a rear portion opposite the cup shaped ball striking face portion which includes an open face and a perimeter portion of the opening face which includes one or more receiving portions for receiving the one or more engaging portions;

a crown portion;

a sole portion;

a toe end portion;

a heel end portion;

a second wall behind the first wall; and a cavity defined between the ball striking face portion and the second wall, wherein the ball striking face portion is configured to be disengaged from the rear portion of the golf club head body, wherein when the ball striking face portion and the rear portion are engaged by the outer perimeter portion of the cup face aligning with the perimeter portion of the open face of the rear portion of the golf club head body and the engaging portions of the ball striking face portion engaging an outer surface of the rear portion of the club head body and being received in the receiving portions of the rear portion of the golf club head body, wherein the second wall is configured to be removably engagable with an interior of the golf club head.

21. A golf club head comprising:

a wood type golf club head body with a double wall structure, wherein the wood type golf club head body includes:

a cup shaped ball striking face portion which includes a first wall, an outer perimeter portion which extends rearwardly away from the first wall;

a rear portion opposite the ball striking face portion which includes an open face and a perimeter portion;

a crown portion;

a sole portion;

a toe end portion;

a heel end portion;

a second wall behind the first wall; and a cavity is defined between the ball striking face portion and the second wall, wherein the ball striking face portion is configured to be disengaged from the rear portion of the golf club head body, wherein the ball striking face portion engages the rear portion of the golf club head body by the outer perimeter portion of the cup face surrounding the perimeter portion of the rear portion of the golf club head body, wherein the rear portion of the golf club head includes a majority of a bottom surface of the wood type golf club head body.

* * * * *